US006639136B1

(12) United States Patent
Judd

(10) Patent No.: US 6,639,136 B1
(45) Date of Patent: Oct. 28, 2003

(54) GUITAR PICK HOLDER

(76) Inventor: Brian Judd, 1663 Whitwood La., #2, Campbell, CA (US) 95008

( * ) Notice: Subject to any disclaimer, the term of this patent is extended or adjusted under 35 U.S.C. 154(b) by 0 days.

(21) Appl. No.: 10/306,402

(22) Filed: Nov. 27, 2002

Related U.S. Application Data

(60) Provisional application No. 60/351,837, filed on Jan. 28, 2002.

(51) Int. Cl.[7] ..... G10D 3/00
(52) U.S. Cl. ..... 84/329; 84/320
(58) Field of Search ..... 84/329, 320, 322, 84/321

(56) References Cited

U.S. PATENT DOCUMENTS

D335,667 S * 5/1993 Kawakami et al. ..... D14/142
5,299,485 A * 4/1994 Denton ..... 84/329
5,488,892 A * 2/1996 Jepsen ..... 84/322
5,651,468 A * 7/1997 Irizarry ..... 211/120
5,796,021 A * 8/1998 Longshore ..... 84/329
5,905,217 A * 5/1999 Byers ..... 84/322
6,054,643 A * 4/2000 Chance et al. ..... 84/322
6,215,052 B1 * 4/2001 Giddens et al. ..... 84/329
6,259,009 B1 * 7/2001 Bolo, III ..... 84/329

* cited by examiner

*Primary Examiner*—Kimberly Lockett
(74) *Attorney, Agent, or Firm*—The Kline Law Firm

(57) ABSTRACT

A pick holder that is secured in the strings of a stringed instrument, specifically a guitar. The pick holder includes an elongated attaching base that is inserted between two of the stings of the instrument. The base of the pick holder is placed between the two strings, and the pick holder is then rotated so that the base is secured between the strings and the upper end of the neck of the guitar, above the first fret. The main body of the pick holder includes a plurality of tapered slots to hold picks. An upper wedge of the main body provides a securing pressure against lower retaining portions.

7 Claims, 1 Drawing Sheet

GUITAR PICK HOLDER

Applicant claims priority of U.S. provisional application Ser. No. 60/351,837, filed Jan. 28, 2002.

BACKGROUND OF THE INVENTION

1. Field of the Invention

The present invention relates generally to musical instruments peripheral equipment, and more particularly is a device that is secured to a guitar or other stringed instruments to hold picks.

2. Description of the Prior Art

A continual annoyance for a musician, particularly guitar players, is trying to keep a pick readily available. The picks are relatively small, and are thus easily misplaced and lost. To solve this problem, a device is needed that secures the pick in close proximity to the instrument.

The prior art has many references directed to such devices. The most common type is a device that is designed to be attached directly to outer surface of the body of the guitar. Some examples of such devices are the "PICK HOLDER" by Jepsen, U.S. Pat. No. 5,488,892, issued Feb. 6, 1996; the "HOLDER FOR THIN PLANAR OBJECTS" by Irizarry, U.S. Pat. No. 5,649,634, issued Jul. 22, 1997; and the "PICK HOLDER FOR GUITARS AND OTHER STRINGED INSTRUMENTS" by Longshore, U.S. Pat. No. 5,796,021, issued Aug. 18, 1998.

Another method of addressing the problem is to attach a pick holding device to a wrist strap. Some examples of patents that embody this solution are the "RETRACTABLE GUITAR PICK HOLDER" by Thompson, U.S. Pat. No. 5,413,020, issued May 9, 1995; the "PLECTRUM HOLDER AND METHOD FOR USING THE SAME" by Newman, U.S. Pat. No. 5,837913, issued Nov. 17, 1998; and the "HOLDER FOR A GUITAR PICK" by Trees, U.S. Pat. No. D362,264, issued Sep. 12, 1995.

While there are many other devices directed to securing guitar picks, the references cited above are representative of the standard methods of attempting to solve the problem. These prior art devices embody some shortcomings that cannot be overlooked. While many of the devices are too complex or cumbersome to be used conveniently, there are two overriding considerations that leads users to reject the current art devices.

The first is that the pick holder can affect the sound produced by the instrument. Because many of the pick holder devices attach directly to the body of the guitar, the vibration and sounding board characteristics of the guitar body can be affected by the addition of the pick holder. This is clearly unacceptable.

Another major problem is the simple fact that the pick holders are affixed to the guitar body by an adhesive of some sort. For a musician who may have invested several hundred or even thousands of dollars on his instrument, remnants of an adhesive used to secure a device to the guitar body are not at all welcome.

Accordingly, it is an object of the present invention to provide a pick holder that can be affixed to a stringed instrument, specifically a guitar, without the use of adhesives.

It is a further object of the present invention to provide a means of attaching the pick holder that does not affect the sound produced by the instrument.

It is a still further object of the present invention to provide a pick holder that is simple and inexpensive to manufacture.

SUMMARY OF THE INVENTION

The present invention is a pick holder that is secured in the strings of a stringed instrument, specifically a guitar. The pick holder comprises an elongated attaching base that is inserted between two of the stings of the instrument. The base of the pick holder is placed between the two strings, and the pick holder is then twisted so that the base is secured between the strings and the upper end of the neck of the guitar, above the first fret. The holder can also be secured at the lower end of the strings if desired.

The main body of the pick holder includes a plurality of tapered pick slots, each adapted to receive a pick. The pick slots are defined between the upper wedge and the lower retaining portions. An upper wedge of the main body provides a securing pressure against the lower retaining portions.

An advantage of the present invention is that the device has a low profile, so that it is not cumbersome when it is in place on the instrument.

Another advantage of the present invention is that the device is secured without the use of any adhesive, thereby preserving the appearance of the instrument.

A still further advantage of the present invention is that it does not affect the sound produced by the instrument.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
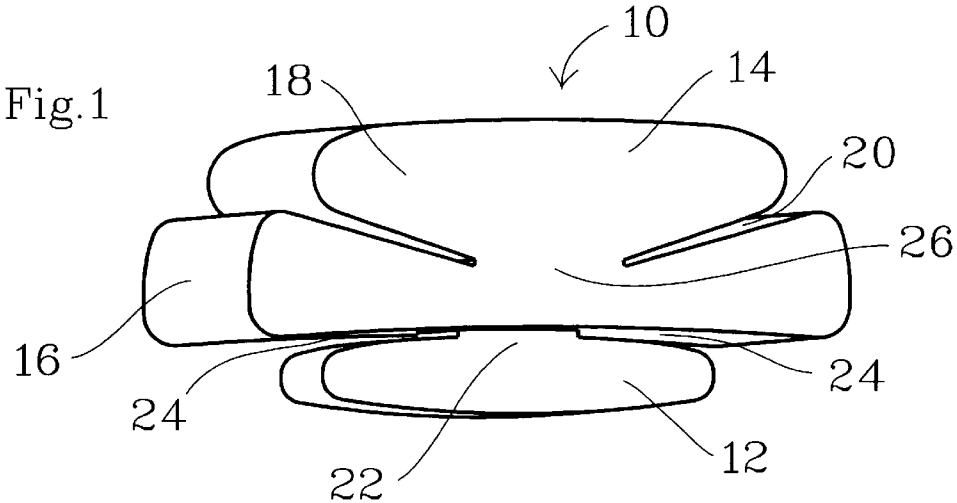
FIG. 1 is a perspective view of the pick holder of the present invention.

With reference now to the several figures of the drawings, the present invention is a pick holder 10. The pick holder 10. comprises an elongated attaching base 12 attached to a main body 14. The main body 14 of the pick holder 10 comprises a pair of opposing lower retaining portions 16 and an upper wedge 18. At least two pick slots 20 are formed between the upper surfaces of the lower retaining portions 16 and the lower surface of the upper wedge 18.

Figure 3:
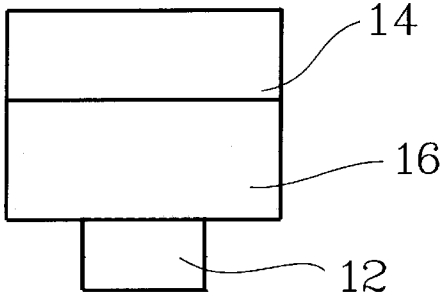
FIG. 3 is a side view of the pick holder.
Figure 2:
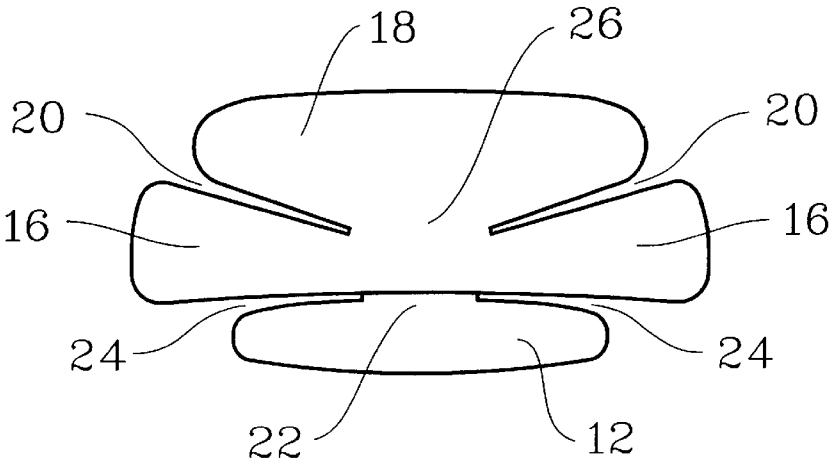
FIG. 2 is a front view of the pick holder.

The attaching base 12 has an oval longitudinal cross section. The base 12 is attached to the main body 14 at an attaching section 22 so that the base 12 is integral to the main body 14. The base 12 is much thinner than the main body 14 of the pick holder 10. (See FIG. 3.) This allows the base 12 to be inserted between a pair of adjacent strings of the subject instrument. The oval shape of the base 12 allows the pick holder 10 to be used on many different instruments.

For example, the strings of an electric guitar will typically be smaller and closer together than the strings of an acoustic guitar. The thin width and the tapered contour of the base 12 allows the pick holder 10 to be inserted between all types of strings, and to maintain sufficient contact after the pick holder 10 is turned to an orientation perpendicular to the strings to hold the pick holder 10 in place. When the pick holder 10 is installed, an adjacent pair of the strings of the instrument are secured in a pair string slots 24. Due to the shape of the base 12, the most narrow part of the string slots

24 is adjacent to the attaching section 22. The width of the string slots 24 increases with distance from the attaching section 22. Thus the more narrow strings that are closer together will be securely gripped in the thinner section of the string slots 24, while the larger, wider spaced strings will be equally securely gripped in the larger section of the string slots 24.

The main body 14 is formed from the lower retaining portions 16 and the upper wedge 18. The lower retaining portions 16 have a flat lower surface, and an upper surface that angles upward from a center section 26. The upper wedge 18 portion of the main body 14 is centered on the lower retaining portions 16. The outer portions of the lower surface of the upper wedge 18 are angled upward at a greater angle relative to the lower surface of the retaining portions 16 than are the upper surfaces of the retaining portions 16. A gap is left between the upper surfaces of the retaining portions 16 and the lower surface of the upper wedge 18 to form at least two pick slots 20. As with the string slots 24, the greater angle of the lower surfaces of the upper wedge 18 cause the string slots 24 to increase in width with distance from the center. This enables the string slots 24 to securely hold a pick of any common width or type.

The pick holder 10 functions best if it is formed from a flexible material. The flexibility of the attaching base 12 enables the pick holder 10 to be very securely situated when the holder 10 is placed between the strings of the guitar. The pick holder 10 is placed above the first fret so that the holder 10 has no effect on the sound produced by the instrument in which it is being used. The ability of the wedge 18 to flex relative to the retaining portions 16 provides a positive retention force for the picks placed in the pick slots 20.

Because of the need for a firm yet flexible material, a rubber such as a thermal plastic elastomer (TPE) has been found to work very well as the material used to construct the pick holder 10. One such material is Santoprene®, manufactured by Advanced Elastomer Systems. The integral construction of the pick holder 10 is most easily accomplished by the use of injection molding.

The pick holder 10 of the present invention is used by first orienting the device with the longitudinal axis of the attaching base 12 parallel to the strings of the subject instrument. The base 12 is placed between the strings, and the pick holder 10 is rotated 90° so that the attaching base is overlaps the strings to hold the pick holder 10 in place on the instrument. The user then simply inserts the pick in one of the pick slots 20. Sufficient pressure is applied to force the upper wedge 18 away from the retaining portion 16. When the user releases the pick, the natural resiliency of the material forming the pick holder 10 causes the pick to be securely held in the pick slot 20.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A pick holder comprising:

an elongated attaching base, and a main body, said main body comprises at least a pair of retaining portions and a wedge portion; wherein a first slot is-formed between said attaching base and said main body, said first slot being adapted to receive. adjacent strings of a stringed instrument, and at least one second slot is formed between said retaining portions and said wedge portion, said second slot being adapted to receive a pick.

2. The pick holder of claim 1 wherein:

an upper surface of said attaching base and a lower surface of said retaining portions are angled relative to each other, so that said first slot increases in width with distance from a longitudinal center point.

3. The pick holder of claim 1 wherein:

an upper surface of said retaining portions and a lower surface of said wedge are angled relative to each other, so that said second slot increases in width with distance from a longitudinal center point.

4. The pick holder of claim 1 wherein:

said pick holder is formed from an elastic material.

5. The pick holder of claim 4 wherein:

said pick holder is formed from a thermal plastic elastomer.

6. The pick holder of claim 4 wherein:

an upper surface of said attaching base and a lower surface of said retaining portions are angled relative to each other, so that said first slot increases in width with distance from a longitudinal center point.

7. The pick holder of claim 4 wherein:

an upper surface of said retaining portions and a lower surface of said wedge are angled relative to each other, so that said second slot increases in width with distance from a longitudinal center point.

* * * * *